US006835098B1

(12) United States Patent
Chang

(10) Patent No.: US 6,835,098 B1
(45) Date of Patent: Dec. 28, 2004

(54) CONNECTOR WITH ELECTRICAL MODULE

(75) Inventor: Chih-Kai Chang, Taoyuan Hsien (TW)

(73) Assignee: Speed THCH Corp., Taoyuan Hsien (TW)

( * ) Notice: Subject to any disclaimer, the term of this patent is extended or adjusted under 35 U.S.C. 154(b) by 0 days.

(21) Appl. No.: 10/663,831

(22) Filed: Sep. 17, 2003

(51) Int. Cl.[7] ..... H01R 13/66

(52) U.S. Cl. ..... 439/620

(58) Field of Search ..... 439/76.1, 620, 439/676

(56) References Cited

U.S. PATENT DOCUMENTS 6,428,361 B1 * 8/2002 Imschweiler et al. ..... 439/676

* cited by examiner

*Primary Examiner*—Ross Gushi
(74) *Attorney, Agent, or Firm*—Birch, Stewart, Kolasch & Birch, LLP

(57) ABSTRACT

The present invention provides a connector with electrical module. According to one aspect of the present invention, the terminals that pass through the through channel of the isolation chassis, comprises securing ends on one end portion to electrically connect with a plurality of contact points of the circuit board, and the other side of the circuit board apart from the terminals is electrically connecting to the transmission terminals of the transmission module. The above circuit board and the transmission module can be set within a space of the isolation chassis, and the plurality of electronic element can be positioned onto the circuit board. Thus the space occupation of the connector on the motherboard can be effectively.

3 Claims, 5 Drawing Sheets

CONNECTOR WITH ELECTRICAL MODULE

BACKGROUND OF THE INVENTION

1. The Field of the Invention

The present invention generally relates to a connector with electrical module, and more particularly to a connector with electrical module, which can be suitably applied in IEEE 1394. The connector with electrical module of the present invention comprises a space in the isolation chassis thereof for receiving circuit board and transmission module, wherein the circuit board is for securing a plurality of electronic elements to reduce the space occupation of the connector on the motherboard.

2. Description of the Related Art

With rapid development of computer technology and the transmission efficiency thereof is also correspondingly upgraded. The most commonly used USB interface comprises two types having higher transmission speed, namely 1.5 Mbps and 12 Mbps, and because the transmission speed thereof are way higher than the parallel port and serial port of the PC, and therefore USB can be advantageously used for upgrading the transmission efficiency of the computer and peripheral interface. However, new generation of IEEE 1394 transmission interface is available for outrageously upgrading transmission efficiency, and that the IEEE 1394 transmission interface being based on the USB plug concept for connecting the peripheral product with the computer system. The maximum number of USB plug that IEEE 1394 supports is 1023, and each BUS contains 63 terminals. Furthermore, the transmission speed of the IEEE 1394 can reach up to 400 Mbps, thus the IEEE 1394 can be considered as a standard for audio multimedia devices, high-speed local area network, hard disk driver, CD ROM and other high-rate peripheral devices. The USB transmission interface mentioned above is now being applied to the low-rate keyboard, mouse, dial-up modem, joy stick, scanner and other likewise devices. But the conventional connector itself mutually creates electromagnetic interference with the power supply and the signal supply during the transmission process, and such electromagnetic interference will cause other electromagnetic interference with the neighboring electronic elements or circuits causing signal transmission errors. Therefore, a filter may be used to prevent the electromagnetic interference. The conventional filter generally is installed on the circuit board of the motherboard and therefore occupies a certain space thereon, and it takes more time and efforts to assemble.

Accordingly, it is highly desirable to design a structure of a connector that is capable of resolving the electromagnetic issue and also to substantially reduce the space occupation thereof on the motherboard.

SUMMARY OF THE INVENTION

Accordingly, in the view of the foregoing, the present inventor makes a detailed study of related art to evaluate and consider, and uses years of accumulated experience in this field, and through several experiments, to create a new connector with electric module. The present invention provides an innovated cost effective connector with electrical module.

According to one aspect of the present invention, the terminals that pass through the through channel of the isolation chassis, comprises securing ends on one end portion to electrically connect with a plurality of contact points of the circuit board, and the other side of the circuit board apart from the terminals is electrically connecting to the transmission terminals of the transmission module. The above circuit board and the transmission module can be set within a space of the isolation chassis, and the plurality of electronic element can be positioned onto the circuit board. Thus the space occupation of the connector on the motherboard can be effectively.

BRIEF DESCRIPTION OF THE DRAWING

For a more complete understanding of the present invention, reference will now be made to the following detailed description of preferred embodiments taken in conjunction with the accompanying drawings, in which.

DETAILED DESCRIPTION OF PREFERRED EMBODIMENTS

Figure 1:
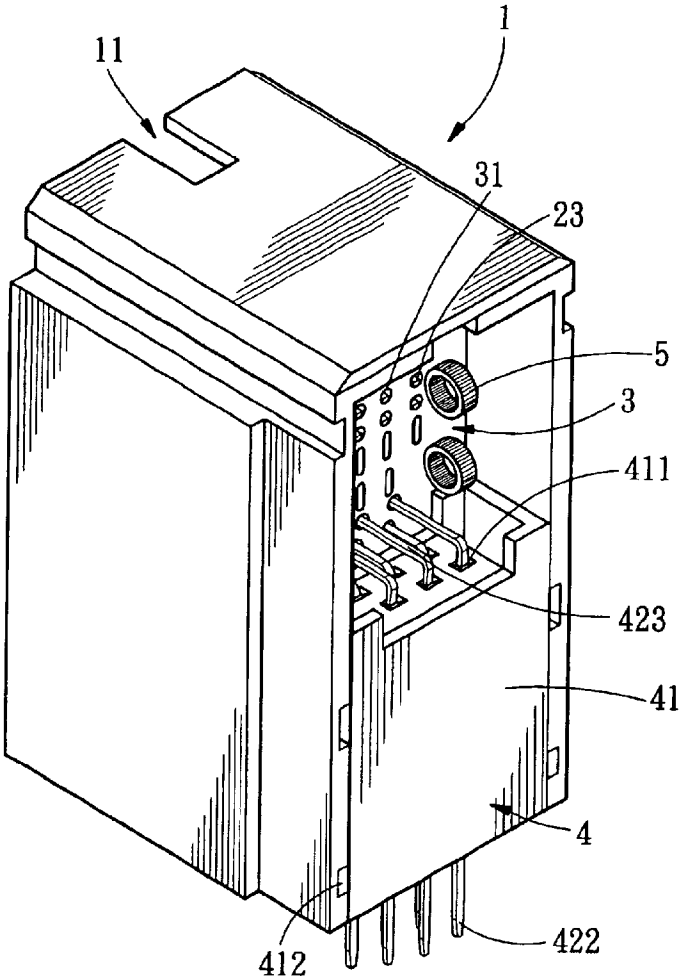
FIG. 1 is an elevational view of the connector with electrical module of the present invention.

Reference will be made in detail to the preferred embodiments of the invention, examples of which are illustrated in the accompanying drawings. Wherever possible, the same reference numbers are used in the drawings and the description to refer to the same or like parts.

Figure 2:
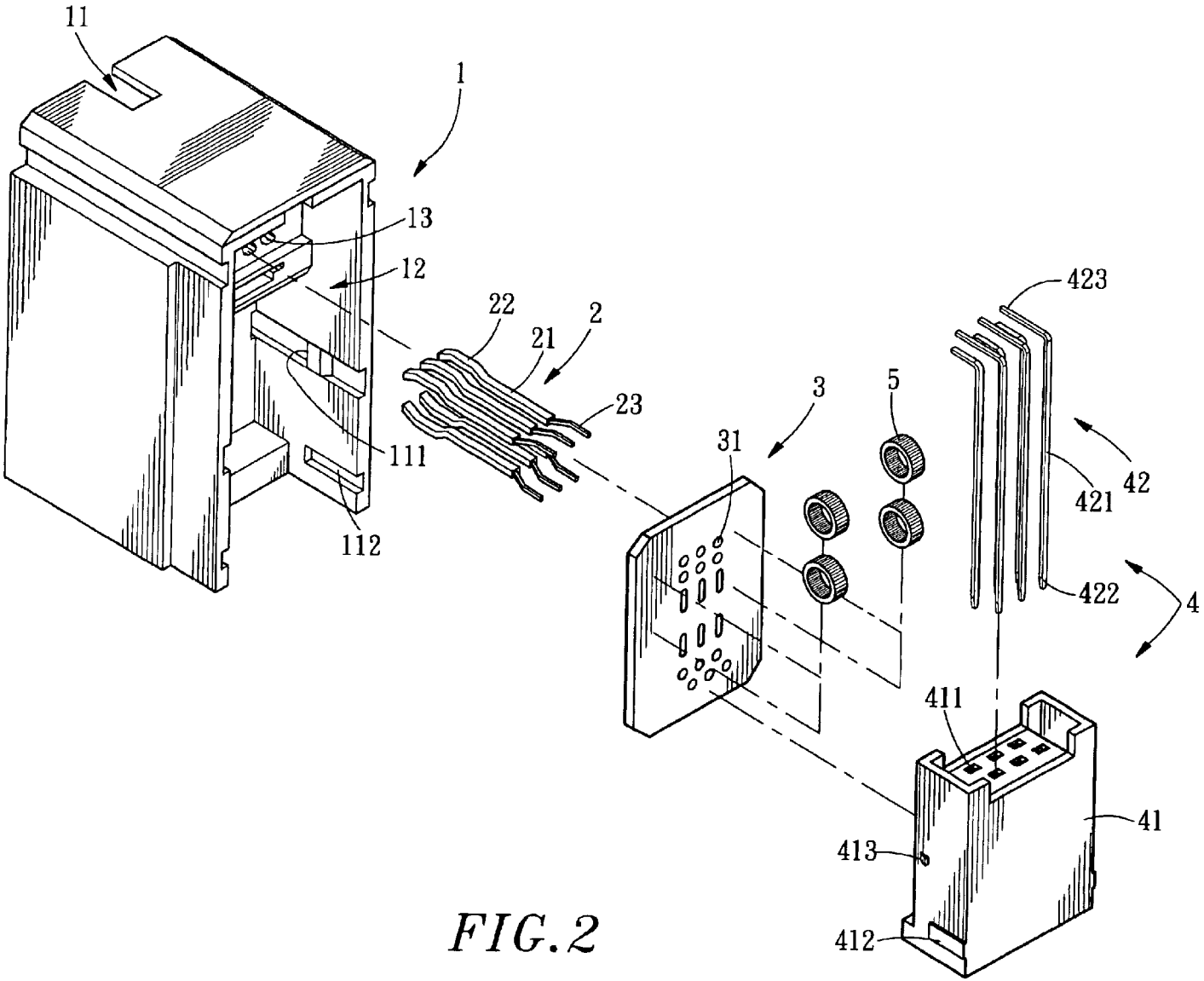
FIG. 2 is an exploded view of the connector with electrical module of the present invention.

Referring to FIGS. 1 and 2, respectively showing the elevational view and the exploded view of the connector with electrical module of the present invention. The connector with electrical module of the present invention comprises an isolation chassis 1, a plurality of terminals 2, a circuit board 3 and a transmission module 4.

The isolation chassis 1 comprises a receiving space 11 at one side and a space 12 formed at the other side and apart from the receiving space 11 thereof. A through channel 13 is formed between the receiving space 11 and the space 12. A buckling groove 111 and groove 112 are disposed on the two sidewalls of the space 12 of the isolation chassis 1.

The terminals 2 comprise a flat base 21, wherein each terminal 2 comprises a connecting end 22 at one side and a securing end 23 at the other.

The circuit board 3 comprises a plurality of contact points 31.

The transmission module 4 comprises a terminal set 41. The terminal set 41 comprises a plurality of through grooves 411 for fitting a plurality of transmission terminals 42. The transmission terminals 42 comprises a welding end 422 at one end portion of the base 421 and a bent securing end 423 at the other end portion thereof Further, the terminal set 41 comprises a track 412 and a buckle 413 positioned separately on the two sidewalls thereof.

Figure 3:
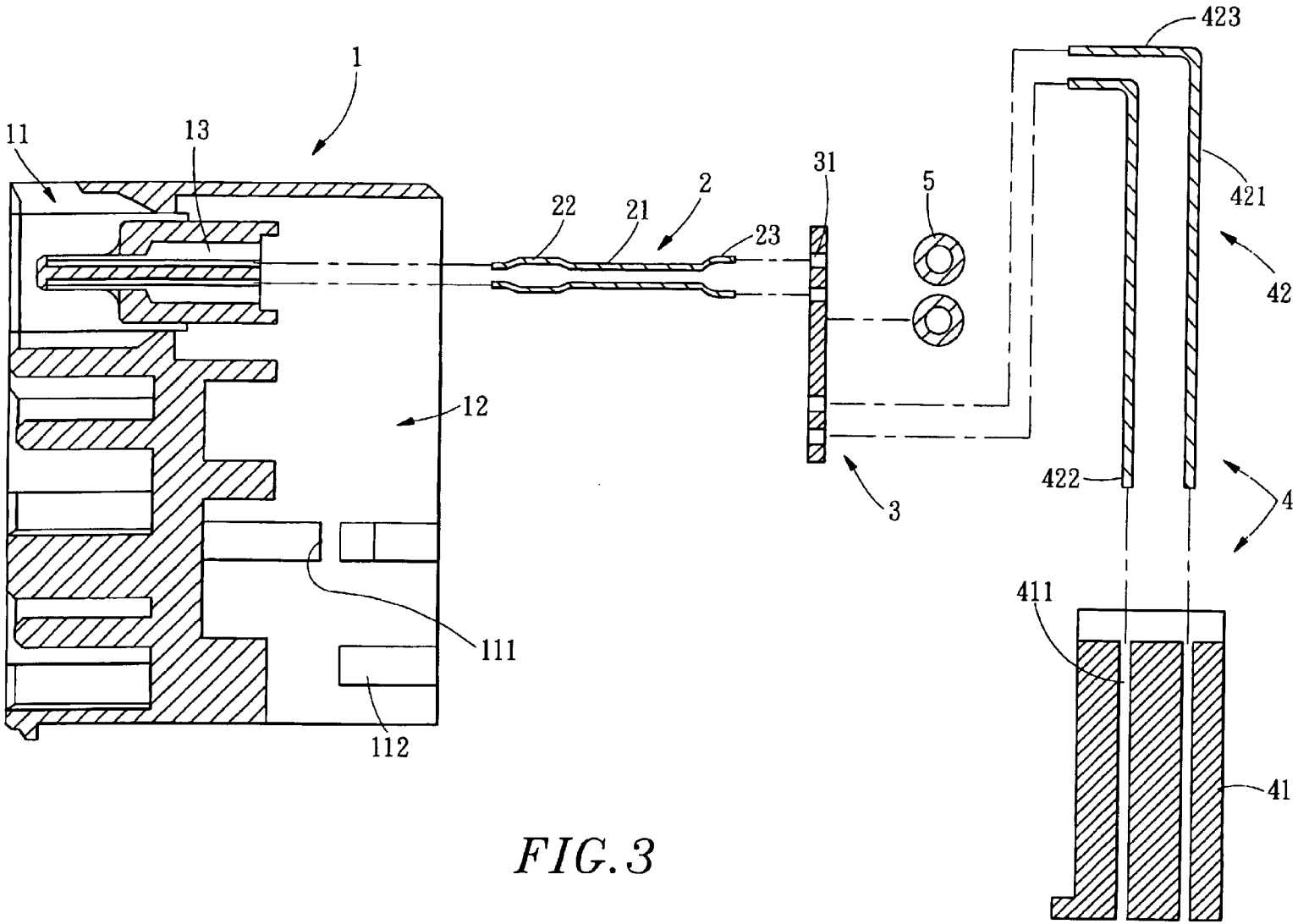
FIG. 3 is a sectional side view before assembling the connector with electrical module of the present invention.
Figure 4:
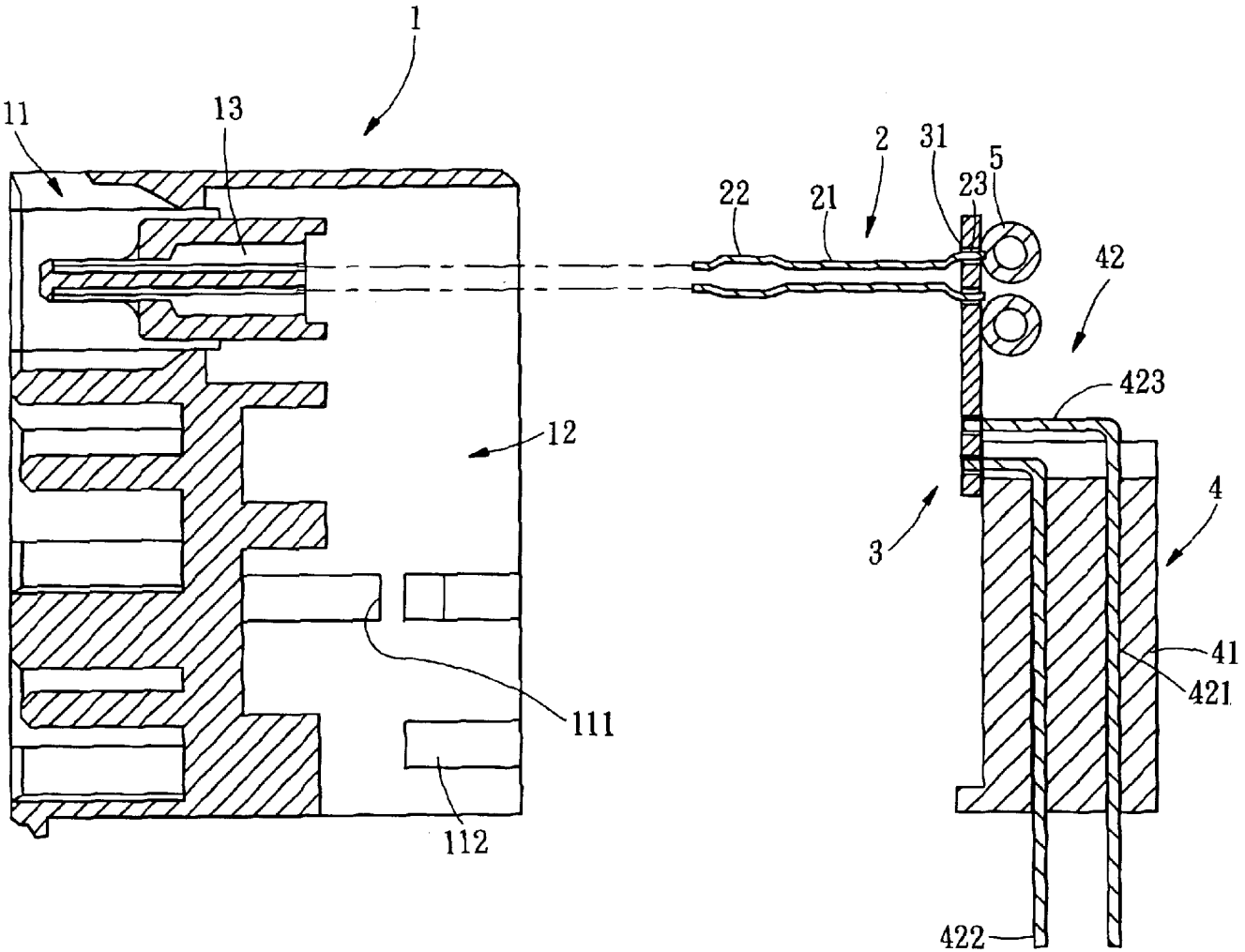
FIG. 4 is a sectional side view while assembling the connector with electrical module of the present invention.
Figure 5:
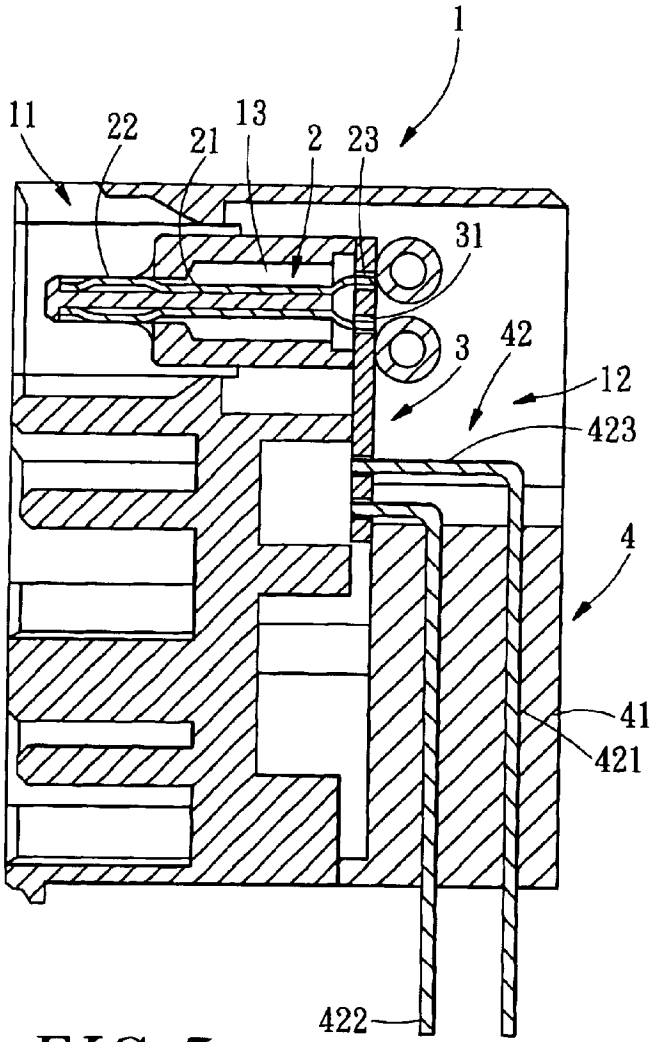
FIG. 5 is a sectional side view after assembling the connector with electrical module of the present invention.

Referring to FIGS. 3, 4 and 5, respectively showing the sectional side views before, while and after assembling the connector with electrical module of the present invention. The assembling of the connector with electrical module of the present invention with reference to FIGS. 3, 4 and 5 as follows. The terminals 2 is fitted into the through channel 13 of the isolation chassis 1 such that the connecting end 22 of the terminals 2 extends out of the through channel 13 of the isolation chassis 1 and position within the receiving space 11 of the isolation chassis 1. Next, the circuit board 3 is fitted into the space 12 of the isolation chassis 1 such that the securing end 23 of the terminals 2 will come in electrical contact with the plurality of contact points 31 of the circuit 3. Then, the transmission module 4 is pushed into the space 12 of the isolation chassis 1 so that the track 412 of the terminal set 41 is inlayed into the groove 112 within the space 12 of the isolation chassis 1. Meanwhile, the buckle 413 of the terminal set 41 is fitted into the buckling groove 111 set within the space 12 of the isolation chassis 1 for positioning, and also for allowing the securing end 423 of the transmission terminals 42 to come in electrical contact with the plurality of contact points 31 of the circuit board 3 as the isolation chassis 1 receives the circuit board 3 and transmission module 4 within the space 12. Finally, a plurality of electronic elements 5 is positioned onto the circuit board 3 and within the space 12 of the isolation chassis 1 so that the space occupation of the connector on the motherboard is substantially reduced.

While the invention has been described in conjunction with a specific best mode, it is to be understood that many alternatives, modifications, and variations will be apparent to those skilled in the art in light of the foregoing description. Accordingly, it is intended to embrace all such alternatives, modifications, and variations in which fall within the spirit and scope of the included claims. All matters set forth herein or shown in the accompanying drawings are to be interpreted in an illustrative and non-limiting sense.

What is claimed is:

1. A connector with electronic module, comprising:

an isolation chassis, said isolation chassis having a receiving space at one side and a space at the other apart from said receiving space, and a through channel between said receiving space and said space;

a plurality of terminals having a flat base, and said base comprising a connecting end at one side and a securing end apart from said connecting end, wherein said connecting end of said terminals can be passed through said through channel of said isolation chassis;

a circuit board, having a plurality of contact points for having electrical contact with said securing end of said terminals and a plurality of electronic elements positioned thereon; and a transmission module, said transmission module having a terminal set for inlaying positioning a plurality of transmission terminals, each said transmission terminals have a welding end formed at one end portion of the base and a bent securing end at other end thereof, wherein said securing end can have an electrical contact with said plurality of contact points set on the other side of said circuit board, and wherein said circuit board and said transmission module can be positioned within said space of said isolation chassis, wherein said space of said isolation chassis comprises buckling grooves on the two sidewalls thereof, and said terminal set of said transmission module comprises corresponding buckles on the two sidewalls thereof for buckling to said buckling grooves of said isolation chassis for positioning.

2. A connector with electronic module, comprising:

an isolation chassis, said isolation chassis having a receiving space at one side and a space at the other apart from said receiving space, and a through channel between said receiving space and said space;

a plurality of terminals having a flat base, and said base comprising a connecting end at one side and a securing end apart from said connecting end, wherein said connecting end of said terminals can be passed through said through channel of said isolation chassis;

a circuit board, having a plurality of contact points for having electrical contact with said securing end of said terminals and a plurality of electronic elements positioned thereon; and a transmission module, said transmission module having a terminal set for inlaying positioning a plurality of transmission terminals, each said transmission terminals have a welding end formed at one end portion of the base and a bent securing end at other end thereof, wherein said securing end can have an electrical contact with said plurality of contact points set on the other side of said circuit board, and wherein said circuit board and said transmission module can be positioned within said space of said isolation chassis, wherein said space of said isolation chassis comprises grooves on the two sidewalls, and said terminal set of said transmission module comprises corresponding tracks on the two sidewalls thereof for fitting into said grooves of said isolation chassis for positioning.

3. A connector with electronic module, comprising:

an isolation chassis, said isolation chassis having a receiving space at one side and a space at the other apart from said receiving space, and a through channel between said receiving space and said space;

a plurality of terminals having a flat base, and said base comprising a connecting end at one side and a securing end apart from said connecting end, wherein said connecting end of said terminals can be passed through said through channel of said isolation chassis;

a circuit board, having a plurality of contact points for having electrical contact with said securing end of said terminals and a plurality of electronic elements positioned thereon; and a transmission module, said transmission module having a terminal set for inlaying positioning a plurality of transmission terminals, each said transmission terminals have a welding end formed at one end portion of the base and a bent securing end at other end thereof, wherein said securing end can have an electrical contact with said plurality of contact points set on the other side of said circuit board, and wherein said circuit board and said transmission module can be positioned within said space of said isolation chassis, wherein said terminal set of said transmission module comprises a plurality of through grooves for positioning said transmission terminals.

* * * * *